United States Patent [19]

VanderSyde et al.

[11] Patent Number: 4,669,716

[45] Date of Patent: Jun. 2, 1987

[54] METHOD AND DEVICE FOR DEFLECTING A SHEET PRIOR TO FEEDING

[75] Inventors: Gary L. VanderSyde, Naperville; Paul Beatty, Chicago, both of Ill.

[73] Assignee: Bell & Howell, Chicago, Ill.

[21] Appl. No.: 759,711

[22] Filed: Jul. 29, 1985

[51] Int. Cl.[4] ..... B65H 3/14

[52] U.S. Cl. ..... 271/98; 271/100; 271/106

[58] Field of Search ..... 271/91, 92, 97, 98, 271/100, 101, 102, 106

[56] References Cited

U.S. PATENT DOCUMENTS

| | | | |
|---|---|---|---|
| 2,743,923 | 5/1956 | Watter | 271/18 |
| 2,745,665 | 5/1956 | Labombarde | 271/106 X |
| 2,806,696 | 9/1957 | Bishop | 271/32 |
| 2,953,371 | 10/1960 | Smith | 271/26 |
| 2,979,329 | 4/1961 | Cunningham | 271/29 |
| 3,099,442 | 7/1963 | Wendricks et al. | 271/32 |
| 3,136,539 | 6/1964 | Lyman | 271/26 |
| 3,168,307 | 2/1965 | Walton et al. | 271/26 |
| 3,168,308 | 2/1965 | Walton et al. | 271/27 |
| 3,198,515 | 8/1965 | Pitney | 271/26 |
| 3,218,062 | 11/1965 | Wickland | 271/98 |
| 3,219,240 | 11/1965 | Hori et al. | 271/11 |
| 3,345,922 | 10/1967 | Williams et al. | 93/54 |
| 3,411,770 | 11/1968 | Albright | 271/26 |
| 3,411,829 | 11/1968 | Albright | 302/29 |
| 3,438,668 | 4/1969 | Olsson et al. | 294/64 |
| 3,511,495 | 5/1970 | Schonfeld | 271/26 |
| 3,539,216 | 11/1970 | Forcier | 294/64 |
| 3,584,587 | 6/1971 | Cargill | 271/32 |
| 3,614,168 | 10/1971 | Range | 302/31 |
| 3,645,526 | 2/1972 | Holecek et al. | 271/32 |
| 3,826,485 | 7/1974 | Shindo | 271/106 |
| 4,116,428 | 9/1978 | Schubert | 271/106 X |
| 4,288,966 | 9/1981 | Aten | 53/469 |
| 4,361,317 | 11/1982 | Lapp-Emden | 271/98 X |
| 4,436,299 | 3/1984 | Orsinger | 271/100 |
| 4,505,470 | 3/1985 | Reinert et al. | 271/100 |
| 4,516,762 | 5/1985 | Moltrasio | 271/106 X |
| 4,518,159 | 5/1985 | Nishibori | 271/106 X |
| 4,531,723 | 7/1985 | Watson | 271/14 |

FOREIGN PATENT DOCUMENTS

| | | | |
|---|---|---|---|
| 113635 | 9/1981 | Japan | 271/97 |
| 283240 | 6/1970 | U.S.S.R. | 271/97 |

*Primary Examiner*—Richard A. Schacher

*Attorney, Agent, or Firm*—Griffin, Branigan & Butler

[57] ABSTRACT

Both positive pressure fluid and negative pressure fluid are used in a method and by an apparatus to at least partially separate a sheet prior to the feeding of the sheet. A carriage 22 having registration arms 160 resiliently coupled thereto is rotated toward a sheet lying in a storage position in a hopper 200. The carriage 22 bears both a positive pressure-communicating port 54 and negative pressure-communicating orifice, preferably in the form of two bellows-type sucker cups 56A, 56B. Positive pressure fluid is applied through port 54 in a manner whereby at least a portion of sheet 220 is attracted to a surface 52 in which ports 54 lie. While positive pressure fluid is being applied, the carriage 22 is rotated away from the storage position of the sheet 220, thereby deflecting at least a portion of the sheet about a first axis 208 of the sheet 220. Negative pressure fluid is then applied through sucker cups 56A, 56B to attract the deflected sheet 220 onto the sucker cups 56A, 56B, thereby deflecting the sheet about the surface 52 and thus about a second axis 230 of the sheet. The carriage 22 is rotated further away from the storage position of the sheet 220, thereby further deflecting the sheet 220 about its first axis 208.

47 Claims, 18 Drawing Figures

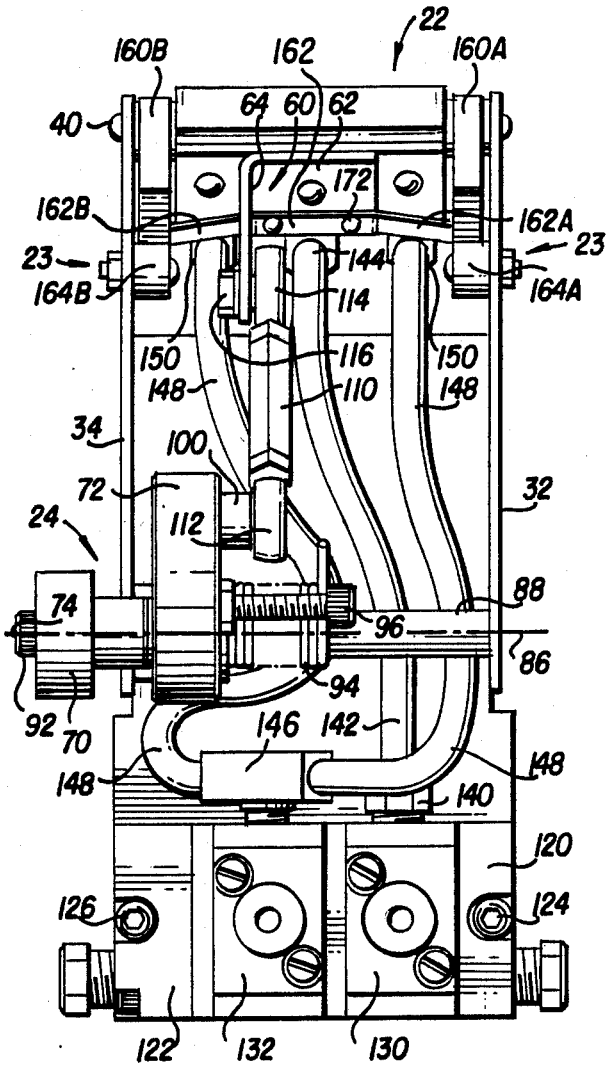
FIG. 2
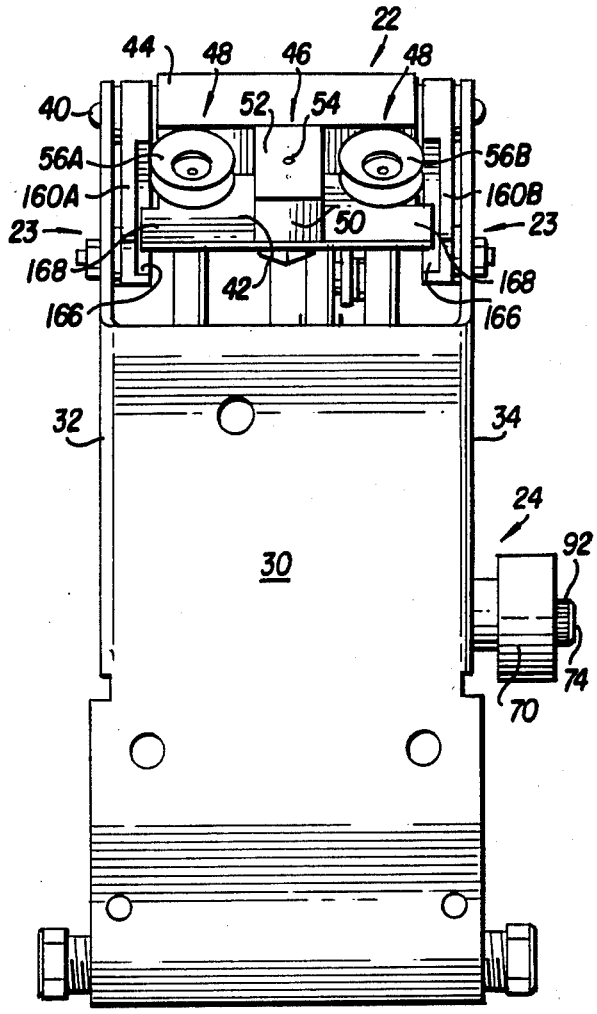
FIG. 3
FIG. 4B
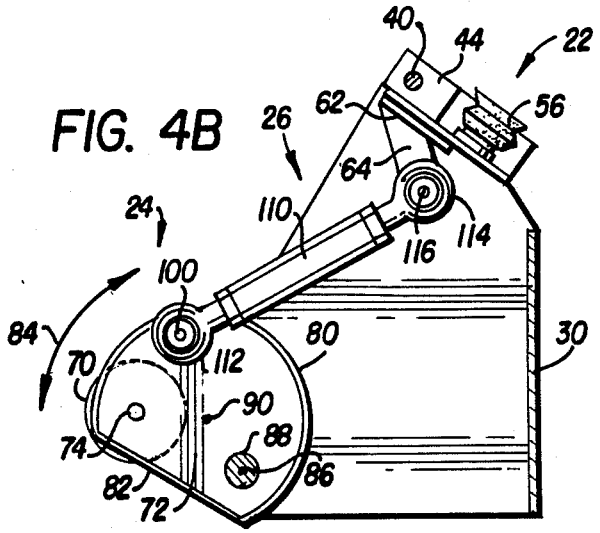

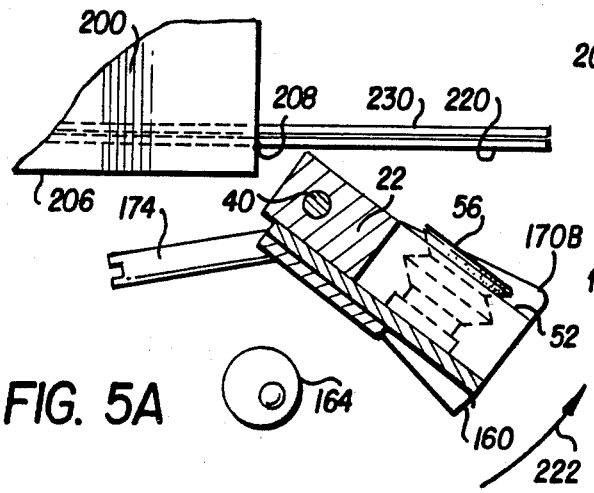
FIG. 5A
FIG. 6A
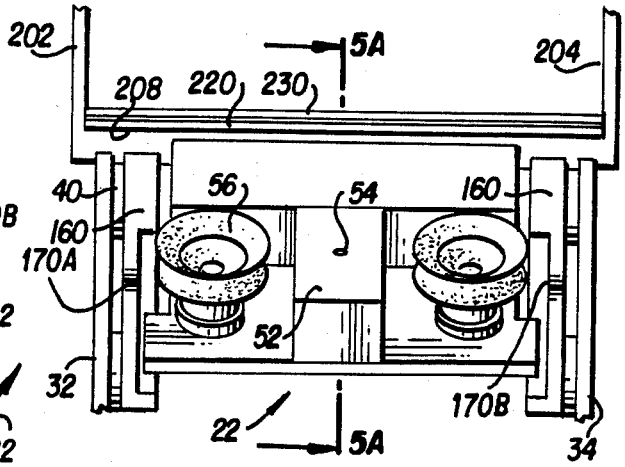
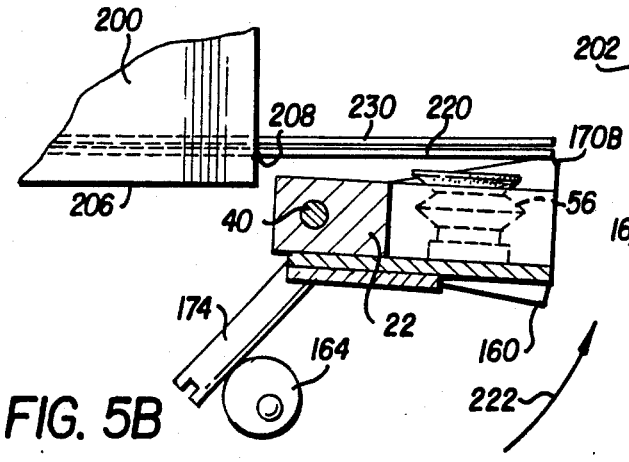
FIG. 5B
FIG. 6B
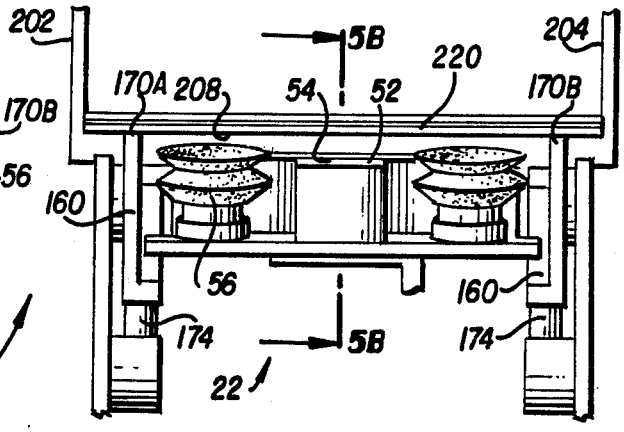
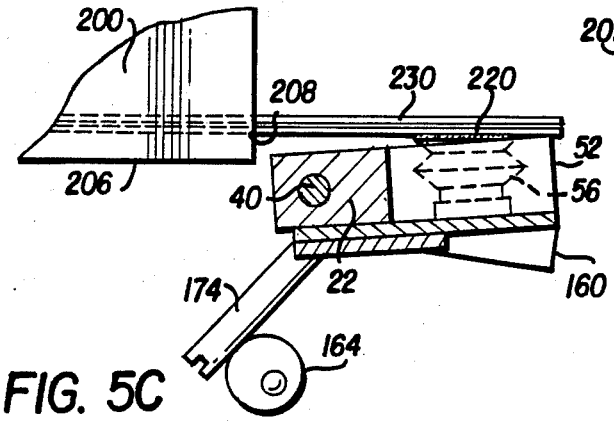
FIG. 5C
FIG. 6C
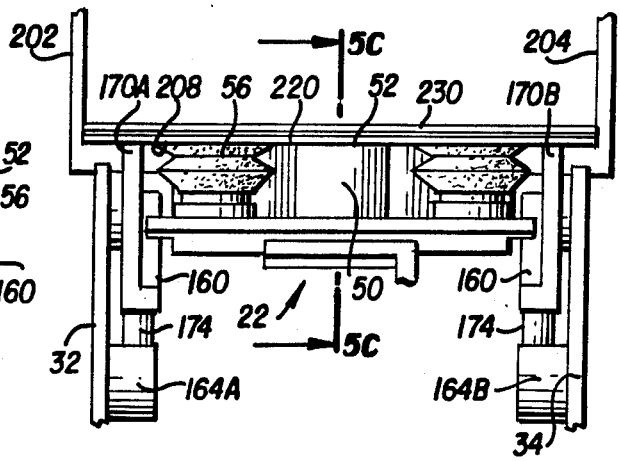

FIG. 6D
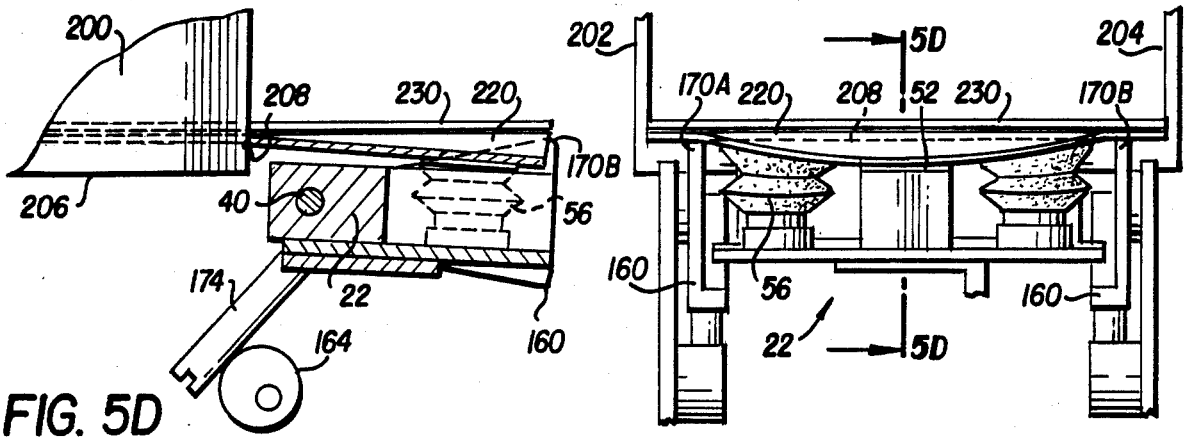
FIG. 5D
FIG. 6E
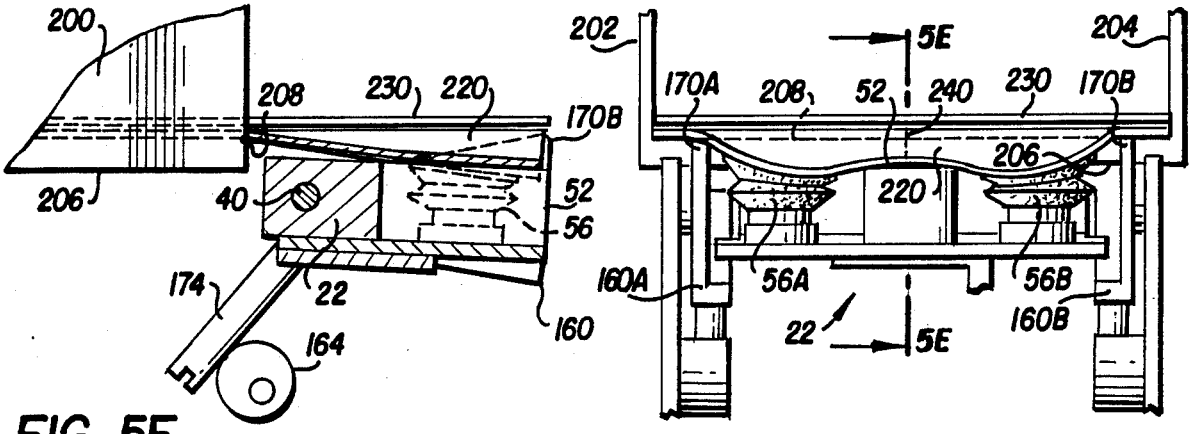
FIG. 5E
FIG. 6F
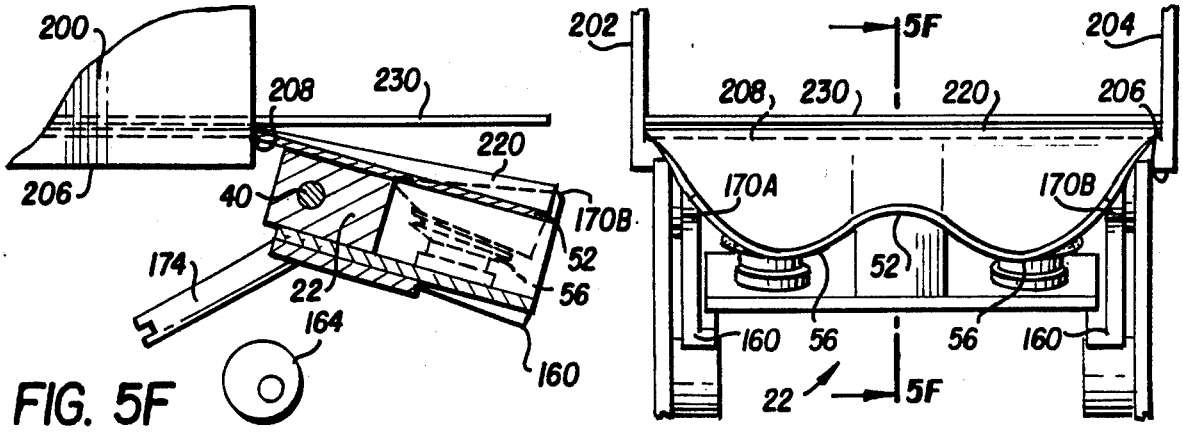
FIG. 5F

METHOD AND DEVICE FOR DEFLECTING A SHEET PRIOR TO FEEDING

BACKGROUND OF THE INVENTION

I. FIELD OF THE INVENTION

This invention pertains to methods and devices for deflecting (i.e., at least partially separating) a sheet such as an insert, and particularly to such methods and devices as are usable in connection with collation or insertion machines of the type wherein inserts are engaged and withdrawn from an insert hopper for deposit onto an insert track for further processing.

II. PRIOR ART AND OTHER CONSIDERATION

For decades vacuum-communicating devices known as "vacuum cups" or "sucker cups" have been used to deflect sheet-like inserts from their associated hoppers in preparation for removal of the inserts from the hoppers. For example, U.S. Pat. No. 2,325,455 to Williams shows an insertion machine wherein at an insert station a lowermost insert document is deflected downwardly by a vacuum-communicating sucker cup. Sucker cups of this type, being mounted beneath their associated hopper, generally rotate upwardly toward a stack of inserts stored in the hopper; vacuum-attract an edge portion of the lowermost insert onto the cup; and, rotate downwardly away from the hopper, thereby causing an edge of the lowermost insert to be deflected downwardly with respect to the hopper floor and, therefore, at least partially separated or selected with respect to the stack of inserts in the hopper. Thereafter a separator device such as a separator foot is operated to be interposed between the deflected portion of the lowermost insert and the other inserts in the hopper. A gripper arm then engages the separated lowermost insert for removal of the insert from the hopper and for placement of the insert on an insert track or raceway.

The hoppers of prior art insert stations generally have a vertical front plate or wall from which two stripper pins typically extend horizontally into the volume defined by the hopper. While much of the surface area of a lowermost insert in such a hopper, particularly rearward portions of the lowermost insert, is supported on the hopper floor in conjunction with a breaker plate, the two stripper pins form a temporary means of at least partial support for the front edge of the lowermost insert.

Insert hoppers typically have different types of documents stored therein for different applications of an insertion machine. In this respect, the type of material stored in an insert hopper can vary from batch to batch. During one batch a sucker cup associated with a hopper may be required to deflect straight single sheets, but during another batch the sucker cup may be required to deflect sheets of any one of a plurality of possible types such as letterfolded sheets, sheets with perforated edges or sheets which are partially perforated, Z-folded sheets, edge-folded sheets, or even booklet-like signatures. The physical characteristics of inserts can also vary from batch to batch. For example, the sheets which are to be deflected by the sucker cup can be either porous, stiff, limp, thin, or thick. Moreover, during any batch a sucker cup may encounter an insert that is defective—an insert that is either misfolded, miscut, or warped, for example.

From the foregoing it is readily appreciated that sucker cups are expected to deflect inserts of varying types and varying characteristics. Therefore, in setting up each insert station in anticipation of a new batch, an operator must determine whether the sucker cup and stripper pin arrangement faces or causes any of a plurality of possible problems in deflecting inserts from the hopper.

A problem associated with the use of prior art stripper pins is that the location of the stripper pins must be adjusted to take into consideration the size of the inserts. These adjustments are generally very delicate and, if done improperly, can disrupt the feeding process. In addition, if some of the inserts at a particular station are irregularly cut or are miscut, the stripper pins may not effectively support nor reliably separate those inserts. Further, the relatively sharp stripper pins have been known to tear the front edges of some inserts during the feeding process.

One problem associated with usage of the conventional sucker cup can arise when a hopper is stacked with inserts of a porous material. The porosity of the insert can permit the vacuum to bleed through the lowermost insert and attract another insert. In order to preclude a mistaken deflecting of two inserts, parameters associated with sucker cup and stripper pin operation must be adjusted whereby the sucker cup just barely contacts the lowermost insert and rapidly rotates away.

Another problem associated with conventional sucker cups is the creation of an induced vacuum that can occur between the lowermost insert (the insert being deflected) and the next-lowermost insert. The rapid deflection of the lowermost insert at least momentarily creates a negative pressure in the region between the two inserts, with the result that the next-lowermost insert is deflected along with the lowermost insert. Creation of an induced vacuum to such an extent may result in an unacceptable "double" feed, resulting in an error condition in the operation of the insertion machine.

From the foregoing it is appreciated that in seeking to solve one problem, the prior art sucker cup devices set up yet another problem. In this regard, as prior art sucker cup devices contact and then rapidly rotate away from porous insert material in order to combat bleed-through, the rapid rotation tends to develop the undesirable induced vacuum.

To overcome the peculiar problems associated with conventional sucker cups, numerous adjustments regarding the sucker cup mechanism and the stripper pins are often made—typically by trial and error—on a station-by-station basis. The adjustments are time-consuming and unfortunately are not completely preventative. In this respect, adjustments are typically made when the machine is operated at a slow or jog speed. At jog speed the machine appears to an observer to be operating in slow motion, and the vacuum is applied through the sucker cup for a longer period of time than when the machine is operating at a higher rate of speed. Thus, the duration of the time period for which a porous insert, for example, feels the vacuum during set-up or adjustment differs from the duration of the time period during which inserts will feel vacuum when the machine is operating at a higher speed. Hence, adjustments made on the basis of conditions occurring at jog speed or upon start up are not necessarily accurate.

Devices in other environments of the sheet handling art have addressed a problem somewhat analogous to the vacuum bleed-through problem described above.

Prior art attempts to solve such a problem include apparatus constructed to operate in a manner to apply Bernoulli's theorem for the attraction of an object such as a sheet, card, or wafer. The utilization of Bernoulli's theorem in this manner is discussed inter alia in U.S. Pat. Nos. 3,438,668; 3,219,340; 3,168,307; and, 3,345,922. In such apparatus a fluid such as air is directed through a tube or head essentially orthogonally to the plane of the object in a manner whereby a low pressure region is formed between a flow boundary surface of the head and the object, with the result that the object is urged by atmospheric pressure into the low pressure region, and thus attracted toward the head. It has hitherto been unrecognized, however, how devices operating on the basis of Bernoulli's theorem could be practically employed in an insertion or collation machine.

In view of the foregoing, it is an object of the present invention to provide an effective method for deflecting sheets from a hopper, and a device which operates in accordance therewith.

An advantage of the present invention is the provision of an easily operated deflecting device and method which eliminates numerous adjusments heretofore required.

Another advantage of the present invention is the provision of a deflecting device and method which properly deflects porous material sheets without deflecting "doubles" as well.

Yet another advantage of the present invention is the provision of a deflecting device and method which significantly reduces induced vacuum considerations.

A further advantage of the present invention is the provision of means which obviates the employment of prior art stripper pins and the adjustment difficulties associated therewith.

SUMMARY

Both positive pressure fluid and negative pressure fluid are used in a method and by an apparatus to deflect a sheet prior to the feeding of the sheet. A carriage having registration arms resiliently coupled thereto is rotated toward a sheet lying in a storage position in a hopper. During at least a portion of the extent of travel to the hopper a predetermined spacing exists between an upper surface of the carriage and sheet-contacting tips of the registration arms. Once the sheet-contacting tips of the registration arms actually contact the sheet in the hopper, the upward movement of the registration arms is terminated although the carriage continues to travel toward the hopper. The carriage bears at least one positive pressure-communicating port and negative pressure-communicating means including at least one and preferably two sucker cups, for example. Positive pressure fluid is applied through the port in accordance with Bernoulli's theorem whereby at least a portion of the sheet is attracted to a surface in which the port lies. While positive pressure fluid is being applied, the carriage is rotated away from the storage position of the sheet, thereby deflecting at least a portion of the sheet about a first axis of the sheet.

Negative pressure fluid is then applied through the compressible sucker cups. As the negative pressure creates a seal between the sucker cups and the sheet, the compressible sucker cups collapse below the level of the surface in which the positive pressure ports lie. The negative pressure attracts the deflected sheet onto the sucker cups, thereby deflecting the sheet about the surface including the positive pressure port and thus about a second axis of the sheet. The carriage is rotated further away from the storage position of the sheet, thereby further deflecting the sheet about its first axis.

The method and apparatus of the present invention provide numerous advantages. Porous sheets are not only attracted by the application of positive pressure, but their porous nature permits the transmission of positive pressure fluid therethrough whereby the positive pressure fluid bears against other sheets in the hopper to prevent the other sheets from following the deflected sheet. Moreover, the deflection of the sheet about a second axis as well as about its first axis creates air pockets which also tend to reduce induced vacuum effects.

BRIEF DESCRIPTION OF THE DRAWINGS

The foregoing and other objects, features, and advantages of the invention will be apparent from the following more particular description of the preferred embodiments as illustrated in the accompanying drawings in which reference characters refer to the same parts throughout the various views. The drawings are not necessarily to scale, emphasis instead being placed upon illustrating the principles of the invention.

FIG. 2 is a rear view of the deflecting device of the embodiment of FIG. 1;

FIG. 3 is a front view of the deflecting device of the embodiment of FIG. 1;

FIG. 4B is a partial side view of a deflecting device showing a carriage oriented in a position rotated away from a hopper;

FIGS. 5A–5F are schematic side views showing sequential steps in the operation of a deflecting device according to a mode of the invention;

FIGS. 6A–6F are schematic cross-sectional views taken along the lines 5—5 corresponding to the sequential steps depicted in FIGS. 5A–5F, respectively; and, FIG. 7 is a perspective view, partially broken away, showing an insertion machine of a type wherein a deflecting device according to an embodiment of the invention is utilized.

DETAILED DESCRIPTION OF THE DRAWINGS

Figure 7:
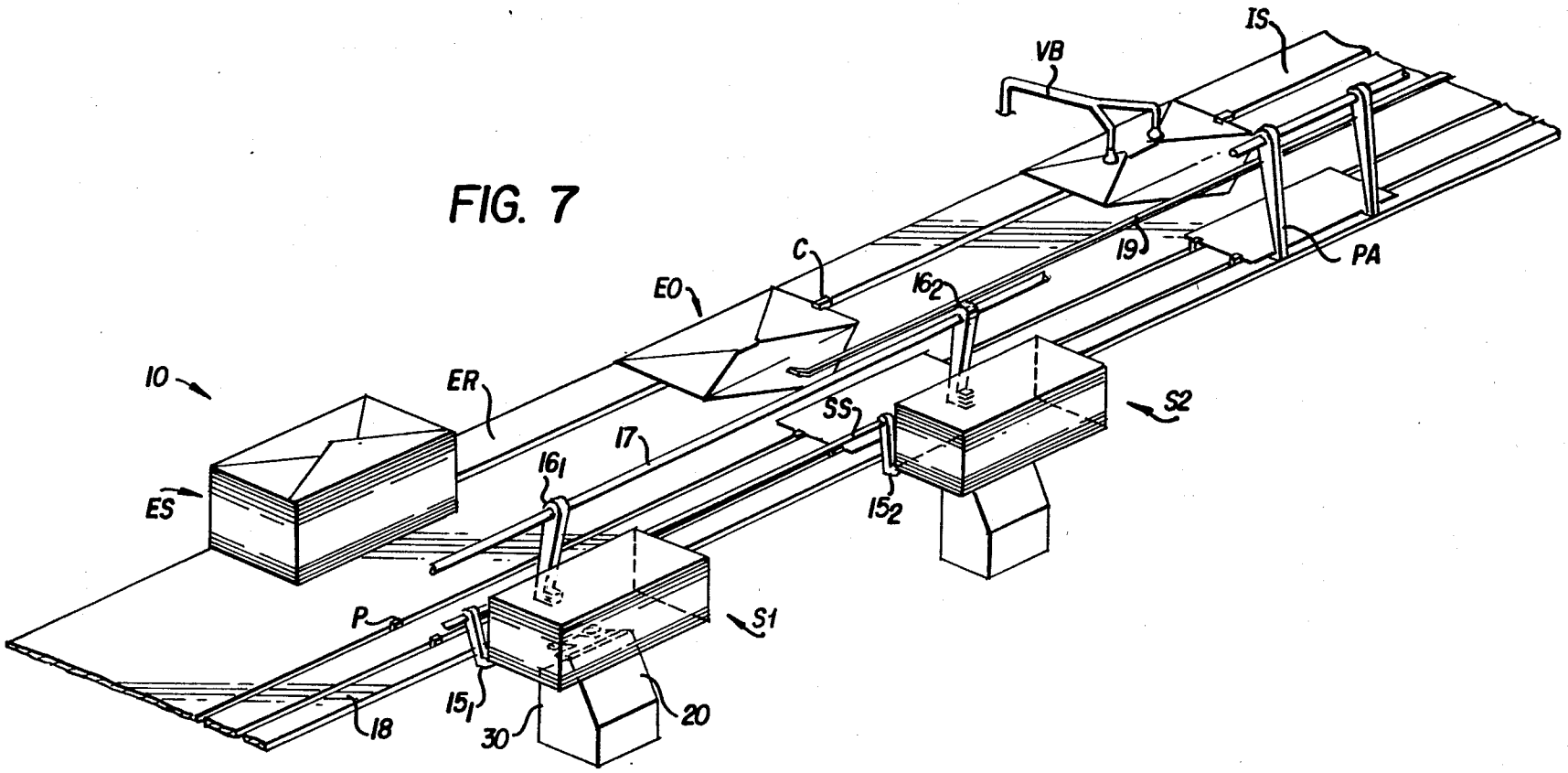

Referring to FIG. 7, there is shown an insertion machine 10 which collects a plurality of inserts into a pile and transports that pile to an inserting station IS; conveys an open envelope to an inserting station IS; and, then inserts the pile of inserts into the envelope. It will be appreciated that the operation of machine 10 is timed in accordance with a machine cycle. In this respect, an individual envelope requires several machine cycles to be processed. With the exception of a few initial or start-up machine cycles, a pile of inserts is inserted into an awaiting corresponding envelope at the end of each machine cycle.

In order for insertion machine 10 to collect a pile of inserts at inserting station IS, there are provided therein a plurality of insert stack stations or hoppers S1 and S2, and a plurality of corresponding separator feet $\mathbf{15}_1$ and $\mathbf{15}_2$ and gripper arms $\mathbf{16}_1$ and $\mathbf{16}_2$. Separator feet $\mathbf{15}_1$ and $\mathbf{15}_2$ are each mounted to a shaft SS which oscillates in bearing blocks mounted on the front of hoppers S1 and S2, respectively. Gripper arms $16_1$ and $16_2$ are each mounted to a shaft 17 which extends over an insert raceway 18. Insert station S1, separator foot $15_1$, gripper arm $16_1$, and shaft 17 serve to withdraw one insert from the stack of inserts and drop that insert onto raceway 18. Separator foot $15_1$ oscillates once during a portion of the machine cycle in order to be interposed between a deflected lowermost insert and the remainder of inserts in the hopper. Gripper arm $16_1$ is connected to shaft 17 which oscillates once during a portion of each machine cycle in order to rotate arm $16_1$ toward and away from the stack of inserts. While rotating toward the stack, the jaws of gripper arm $16_1$ are opened to allow the arm to engage the deflected bottommost insert. When the shaft 17 stops moving arm $16_1$ toward the stack, the jaws are closed to engage the bottommost insert. Shaft 17 then rotates gripper arm $16_1$ away from the stack, thereby withdrawing the insert from the bottom of the stack. Gripper arm $16_1$ then opens its jaws to release the insert which falls onto insert raceway 18. Thus, insert station S1, gripper arm $16_1$, and shaft 17 cooperate to withdraw one insert from the stack and drop that insert onto raceway 18.

Insert raceway 18 includes a plurality of pairs of pusher pins P which are mounted on a pair of chains (not shown) which are periodically driven by machine 10. The chains are driven once during a portion of each machine cycle and move the pusher pins P to the next insert station. After the just-described dropping of an insert from station S1 onto raceway 18, for example, pins P push the insert to the vicinity of the insert station S2 and stop.

Insert station S2, separator foot $15_2$, gripper arm $16_2$, and shaft 17 cooperate in a similar manner as insert station S1, separator foot $15_1$, gripper arm $16_1$, and shaft 17 and serve to withdraw one insert from the stack of inserts at station S2 and drop that insert onto raceway 18. Thus, during another machine cycle, insert station S2, gripper arm $16_2$, shaft 17, and raceway 18 cooperate to add an insert and convey the pile to inserting station IS.

As mentioned above, insertion machine 10 conveys an open envelope to inserting station IS. To this end there are provided an envelope stack station ES; an envelope flap opening station EO; a flap hold down bar 19; and, an envelope raceway ER. Envelope stack station ES holds a stack of envelopes; separates the bottommost envelope from the rest of the stack; and, feeds the envelope to a clamp C in envelope raceway ER. Envelope raceway ER includes clamp C which is mounted on a chain (not shown) which is periodically driven by machine 10. The chain is driven once during a portion of each machine cycle and moves the envelope to an envelope flap opening station EO. At station EO, a sucker cup (not shown) rotates toward the closed flap of an envelope, applies a vacuum to the flap and rotates away from the envelope in order to open the flap of the envelope. The envelope raceway ER then moves the envelope to the inserting station IS while the flap of the envelope is held down by bar 19.

When an envelope and a pile of inserts are at inserting station IS, insertion machine 10 inserts the pile of inserts into the opened envelope. To this end, there are provided in machine 10, a pusher arm PA, and a vacuum bar VB. The vacuum bar VB lifts up the back (top) side of the envelope and shaft 17 rotates and thereby moves pusher arm PA toward the opened envelope. As a result, the pile of inserts will be pushed into the envelope. Thus, pusher arm PA and vacuum bar VB cooperate to insert a pile of inserts into an opened envelope at inserting station IS.

Figure 1:
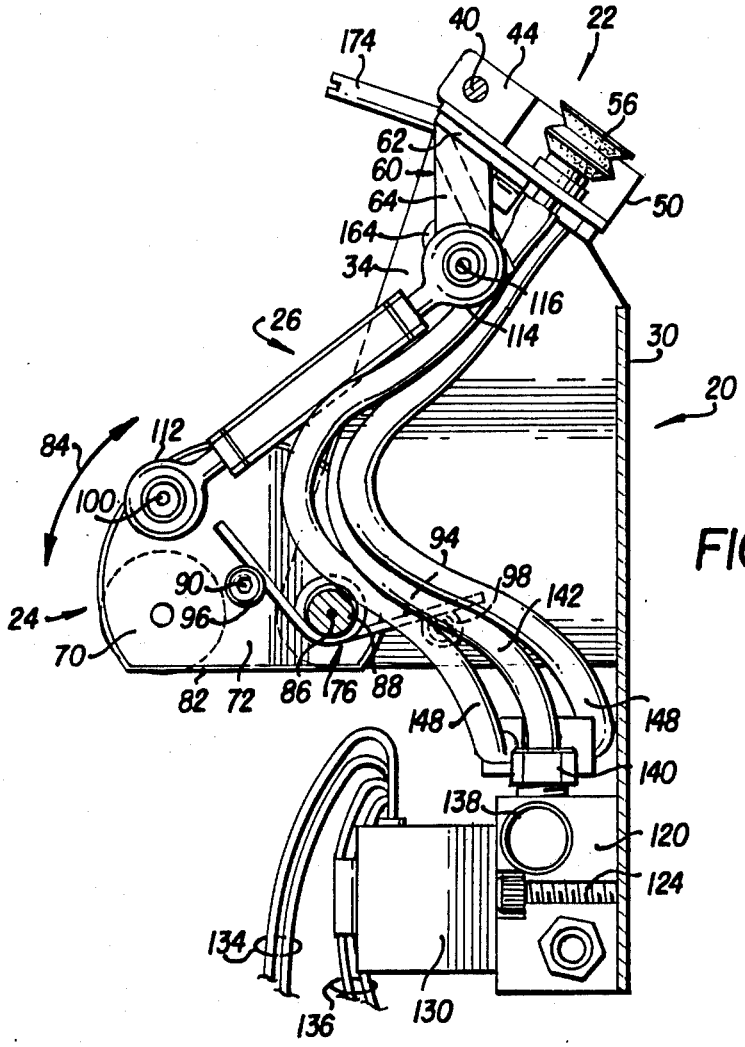
FIG. 1 is a cut-away side view of a deflecting device according to an embodiment of the invention.
Figure 4A:
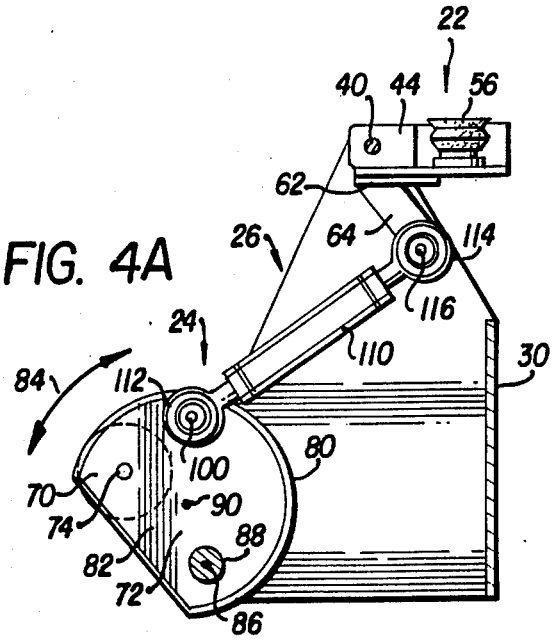
FIG. 4A is a partial side view of a deflecting device showing a carriage oriented in a position rotated toward a hopper.

As shown in FIG. 7 each insert station S1 and S2 includes a deflecting or separating device for at least partially separating a lowermost insert from a stack of inserts stored therein. In this regard, FIGS. 1, 2, and 3 show a deflecting or separating device comprising a frame 20; a carriage 22; sheet registration means 23; a carriage control means 24; and, linkage means 26. The frame comprises a front plate 30; a left side plate 32; and a right side plate 34. The front plate 30 is oriented essentially vertically and is attachable to a suitable device near the side of an insert raceway as shown in FIG. 7.

At the upper extremity of the frame 20 the carriage 22 pivots about an axis defined by shaft 40. The shaft 40 has its left and right ends captured between the left and right side plates 32, 34 respectively, of frame 20.

Carriage 22 comprises a base plate 42. Mounted across the rear width of base plate 42 is a rectangular block 44 in which the shaft 40 is rotatably received by means of unillustrated bearings in the interior of block 44. Also mounted on base plate 42 are positive pressure fluid application means 46 and negative pressure fluid application means 48.

In the above regard, the positive pressure fluid application means 46 comprises an essentially rectangular block 50 mounted on an intermediate portion of the frontward part of base plate 42. An upper surface of block 50 is an essentially rectangular surface 52 having a port 54 therein. In alternate embodiments more than one port is provided in surface 52. The negative pressure fluid application means 48 comprises two vacuum cups or sucker cups, one cup 56A being to a left side of block 50 and a second cup 56B being to a right side of block 50. The sucker cups 56 are compressible, bellows-type sucker cups.

The carriage 22 further comprises a bracket 60. A first arm 62 of bracket 60 is secured by an unillustrated fastener to the back of the base plate 42. It should also be understood that bracket 60 is, in other embodiments, be welded or otherwise secured to the back of base plate 42. A second arm 64 of the bracket 60 extends rearwardly (perpendicularly out of the plane of FIG. 2) from the base plate 42 but is inclined in an angle along a plane parallel to the plane of FIG. 1.

The carriage control means comprises a cam follower assembly which follows an unillustrated cam. The cam follower assembly comprises a cam follower roller 70; an eccentrically-mounted reciprocating plate 72; fastening means 74 for rotatably fastening the follower roller 70 to the plate 72; and, biasing means 76 for biasing the follower roller 70 and the plate 72 in riding relationship with the illustrated cam.

From its side the eccentrically-mounted plate 72 appears circular in shape but with a chordal segment removed therefrom. Thus, the eccentrically-mounted plate 72 has a circular edge 80 and a chordal flat edge 82. The plate 72 is adapted to reciprocate in the direction of arrow 84 about an axis 86 under the control of the illustrated cam 68. The reciprocation of plate 72 is facilitated by the fact that the plate 72 is rotatably and eccentrically-mounted by means of a bearing or the like on a shaft 88, shaft 88 being colinear with axis 86. The ends of shaft 88 are captured between the end plates 32 and 34 of frame 20.

A first side of the eccentric plate 72 has the follower roller 70 mounted thereon. In this respect, a threaded fastener 74 extends through the follower roller 70 and anchors the follower roller 70 to a point intermediate the periphery of the plate 72 and the plate's center 90. The follower roller 70 is rotatably mounted about fastener 74 by a bearing-type structure and is retained thereon by a fastener head 92.

The follower roller 70 is biased to ride on cam the illustrated by biasing means 76 comprising spring 94. Spring 94 has an intermediate portion thereof helically wrapped around shaft 88. A first end of the spring 94 tangentially extends from the axis of the helix to bear against a head of a fastener 96. Fastener 96 has the base of its shaft anchored near the center 90 of the eccentric plate 72. A second end of spring 94 tangentially extends from the axis of the helix to bear against a head of a fastener 98. Fastener 98 has the base of its shaft secured to right side plate 34.

A second side of the eccentric plate 72 has a first end of a pin 100 mounted near a peripheral portion of the plate 72 in a manner whereby the pin 100 extends essentially perpendicularly to axis 86. A second end of the pin 100 is connected to the linkage means 26 in the manner next described.

The linkage means 26 comprises an elongated rectangular turnbuckle element 110 which has tie rod ends or gimbal-like connectors 112, 114 secured to opposing ends thereof. Each connector 112, 114 comprises an essentially torodial member having a central circular cavity adapted to rotatably receive an end of a pin. One of the tie rod ends is right-hand threaded while the other of the tie rod ends is left-hand threaded to facilitate operation adjustment. In this respect, connection 112 receives pin 100 mounted on the second side of the eccentric plate 72. Connector 114 receives a pin 116 which rotatably secures arm 64 of bracket 60 to connector 114.

Manifolds and solenoid valves are mounted near the bottom of frame 20. In this respect, a positive pressure manifold 120 and a vacuum manifold 122 are mounted by threaded fasteners 124 and 126 to the front plate 30 of the frame 20. Mounted on each manifold is an associated solenoid valve. In this respect, the positive pressure manifold 120 has a positive solenoid valve 130 mounted thereon and the negative pressure manifold 122 has a solenoid valve 132 mounted thereon. The valves 130 and 132 are connected by appropriate sets 134 and 136, respectively, of electrical wires to appropriate electrical circuitry which governs the timing of the operation of the valves. Positive pressure manifold 120 has a port 138 on a side thereof which is connectable to an unillustrated source of fluid. Likewise, the negative pressure manifold has an unillustrated port also connected to an unillustrated source of fluid.

A fitting 140 connects the interior of positive pressure manifold 120 with a first end of a hose 142. A second end of the hose 142 is connected by a fitting 144 to the underside of the carriage base plate 42. Fitting 144 connects the second end of the hose 142 in a manner to communicate with the interior of the positive pressure fluid application means 46 and thus with ports 54.

A T-shaped fitting 146 connects the interior of the negative pressure manifold 122 with the first end of two hoses 148. The second ends of the hoses 148 are connected by fittings 150. Fittings 150 are mounted on the underside of the carriage base plate 42 and facilitate the communication of negative pressure fluid between the hoses 148 and the stems of the sucker cups 56.

The sheet registration means 23 comprises a pair of registration arms 160A, 160B; registration arm coupling means such as resilient leaf spring 162; and, a pair of registration arm stop means 164A, 164B.

The registration arms 160A, 160B are each elongated cantilever members having a proximal end thereof rotatably mounted on the shaft 40. In this respect, the proximal end of arm 160A is rotatably mounted on shaft 40 between frame sidewall 34 and carriage 22; the proximal end of arm 160B is rotatably mounted on shaft 40 between frame sidewall 32 and carriage 22. Thus, the registration arms are spaced apart from one another and are on opposite sides of carriage 22.

Near their distal ends each registration arm 160 is essentially L-shaped in cross-section as seen in a plane perpendicular to the axis of elongation of arm 160. The bottom legs of the L-shaped arm members are oriented to face the carriage 22. Upper ledge surface 166 of the bottom legs of arms 160 are adapted to contact the undersides of corresponding protrusions 168 on carriage base plate 42. As seen hereinafter, protrusions 168 on carriage base plate 42 serve as limit stops to preclude the registration arms 160 from travelling too far relative to the travel of carriage 22.

The distal ends of the registration arms 160 have tapered raised tips 170 thereon. In this respect, in the illustrated embodiment, at tips 170 the registration arms are $\frac{1}{8}$ inch thicker than at the proximal ends of arms 160 (the measurements being taken in a plane perpendicular to the axis of elongation of arms 160).

The resilient leaf spring 162 which comprises the registration arm coupling means has an intermediate portion thereof which is secured by fasteners, such as screws 172, to the underside of the bottom carriage base plate 42. The ends 162A, 162B of the leaf springs 162 are connected to registration arms 160A, 160B, respectively in a manner whereby the motion of carriage 22 is transmissible via the coupling of leaf spring 162 to the registration arms 160.

As shown in FIG. 1 and various frames of FIGS. 5 and 6, the registration arms 160 each have a tail portion 174 connected to the proximal ends thereof. The tail portions 174 are connected to registration arms 160 in a manner whereby, when the distal ends of registration arms 160 assume an essentially horizontal orientation, the tail portions are oriented at downwardly and rearwardly an angle of about 45° to the horizontal orientation.

The registration arm stops 164A, 164B are essentially cylindrical members mounted on frame left side plate 32 and frame right side plate 34, respectively. The stops 164A, 164B are positioned on side plates 32, 34 in a manner whereby the stops 164A, 164B are contacted by the underside of tail portions 174 when registration arms 160 are oriented essentially horizontally.

FIGS. 5 and 6 are referenced hereinafter in conjunction with the description of the operation of the deflecting device herein described. By way of basic representation FIGS. 5 and 6 show a hopper 200 having a left sidewall 202; a right sidewall 204; and, a bottom floor or breaker plate 206. The top of the breaker plate has a front most edge 208 which serves as a breaker edge. A lowermost sheet 220 is shown as lying in its flat (i.e., straight, undeflected) position in the hopper 200.

OPERATION

When cam follower roller 70 rides on a first surface of an unillustrated cam, the carriage 22 rotates about the axis of shaft 40 upwardly in the direction of arrow 222 as shown in FIG. 5A. In this respect, roller 70 riding on the first surface of the unillustrated cam and acting through the linkage means 26 causes plate 72 to rotate in the clockwise sense as shown by arrow 84, thereby causing carriage 22 linked thereto to pivot in a counter-clockwise sense about the axis of shaft 40. By virtue of the action of the coupling leaf spring 162, the counter-clockwise motion of carriage 22 is transmitted to the registration arms 160, whereby registration arms 160 also pivot in the counter-clockwise sense about the axis of shaft 40. In this regard, the ends of leaf spring 162A, 162B carry the respective registration arms 160A, 160B upwardly toward the hopper.

As the carriage 22 and registration arms 160 travel together in this manner, the tips 170 of the distal ends of the registration arms 160 precede the carriage 22, and particularly surface 52 of carriage 22. In this respect, as carriage 22 and arms 160 travel together the tips 170 extend approximately $\frac{1}{8}$ inch above the surface 52. Thus, the coupling leaf spring 162 permits the registration arms 160 to travel toward the hopper 200 in a manner whereby the motion of the arms 160 is related to the motion of the carriage 22 and the fluid application means 46 and 48 mounted thereon, the relation being inter alia the fact that a predetermined spacing exists in the direction of travel between the tips 170 of registration arms 160 and the surface 52 during at least a portion of the extent of travel of the carriage 22 upwardly in the direction of arrow 222.

As the carriage 22 and registration arms 60 travel upwardly together toward the hopper 200, the registration arms 160 are precluded by protrusion stops 168 on carriage base plate 42 both from travelling faster than carriage 22 and from exceeding the predetermined spacing. In this regard, the upward motion of the registration arms 160 is contained by the action of the underside of protrusion stops 168 which capture the ledges 166 of registration arms 160 between the stops 168 and the leaf spring 162.

As the carriage 22 and registration arms 160 travel together toward the hopper, the tail portion 174 of each registration arm pivots in a counter-clockwise sense about the axis 40. Tails 174 of registration arms 160 continue pivoting in this clockwise sense until, as illustrated in FIGS. 5B and 6B, the underside of the tails 174 hit their corresponding registration arm stop 164. In this respect, stops 164A, 164B are mounted on frame side plates 32, 34, respectively, at points whereat the motion of registration arms 160 upwardly toward the hopper 200 is terminated at just the time the tips 170 of arms 160 contact the underside of the next-awaiting or lowermost sheet 220 in the hopper.

Although the motion of the registration arms 160 in the counter-clockwise direction about axis 40 ceases when the tails 174 hit the stops 164, the carriage 22 continues to travel upwardly in the counter-clockwise sense toward the sheet 220. In this regard, the ends 162A, 162B of the resilient leaf spring 162 flex as the ends of spring 162 connected to the arms 160 remaining stationary while the remainder of the spring 162, being affixed to carriage 22, continues to travel upwardly.

As the carriage 22 continues to travel toward the sheet 220, the upper surface of the bellows-like sucker cups 56 begin to compress as the sucker cups 56 contact the underside of sheet 220. Eventually the carriage 22 rotates to an essentially horizontal position, as shown in FIGS. 5C and 6C, at which point the rectangular surface 52 of the positive pressure fluid application means 46 contacts the underside of sheet 220. At this point the sucker cups 56 are sufficiently compressed whereby the tops of sucker cups 56 are essentially level with the surface 52.

When the carriage 22 reaches its furthermost extent of counter-clockwise travel as determined by the carriage control means 24, and particularly by the roller 70 reaching a specified point on the unillustrated cam, the carriage 22 lies just below and contacts the lowermost sheet 220 lying in the hopper 200 (see FIGS. 5B and 6B). At this point an electrical signal applied on an appropriate one of the wires in set 134 causes solenoid valve 130 to generate a positive pressure in the manifold 120. The positive pressure fluid and manifold 120 is communicated through hose 142 to port 54 comprising the positive pressure application means.

As the positive pressure fluid is turned on in the manner just described, roller 70 begins to ride on a second surface of the unillustrated cam, thereby causing the carriage to travel downwardly away from the hopper 200 (i.e., to pivot in the clockwise sense about the axis of shaft 40). At this point the registration arms 160 are still stationary.

The positive pressure fluid discharging from port 54 sets up two conditions. First, the positive pressure fluid issues from port 54 in a manner whereby, in accordance with Bernoulli's theorem, the lowermost sheet 220 is attracted toward the surface 52 in which port 54 is formed. In this respect, the attraction causes sheet 220 to at least partially deflect about a first axis thereof, the first axis being essentially at the top front edge 208 of the breaker plate 206. In functioning in accordance with Bernoulli's theorem, the surface 52 with port 54 therein resembles an air bearing to which sheet 220 is attracted but about which the sheet 220 can float.

FIGS. 5D and 6D show the deflection of sheet 220 about its first axis in accordance with the application of Bernoulli's theorem. During the early steps of the Bernoulli attraction the tips 170 of the registration arms are still unmoved, with the tips supporting at least the front edges of the sheet 220. At this point the sheet 220 appears from the front of the hopper to be bowed downwardly at the middle of its front edge. In other words, the upward support for the front edges of the sheet 220 by the tips 170 of the registration arms 160 and the attraction of an intermediate frontal portion of the sheet 220 toward the positive pressure fluid application means causes the sheet 230 to see a concave upperside of the sheet 220, with the sheet 220 also being deflected about the breaker plate edge 208. Conversely, the surface 52 sees the underside of sheet 220 bulging downwardly in convex fashion, the front ends of sheet 220 being supported by tips 170 of registration arms 160. Thus, from the front of the hopper the sheet 220 is viewed as having a trough at the middle of its front edge.

The second condition set up by the discharge of the positive pressure fluid from port 54 occurs when the sheet is of a porous material. In this regard, the positive pressure fluid is transmitted through the porous material so that a positive pressure region is created between the top surface of sheet 220 and the next lowermost sheet 230 in the hopper 200. This positive pressure counteracts forces which might otherwise tend to create an induced vacuum in this region.

With the sheet attracted to carriage 22 as a result of the application of Bernoulli's theorem as described above, under the influence of the carriage control means 24 the carriage 22 is rotated away from the storage (i.e., straight, undeflected) position of the sheet. In this regard, the carriage 22 is rotated downwardly about the axis of the shaft 40 in the clockwise direction to an extent that the front edge of sheet 220 is almost ⅛ inch lower than it was in the storage position. This rotation in the clockwise direction occurs as roller 70 follows the second surface of the unillustrated cam. The deflected (i.e., partially separated) portion of sheet 220, being attracted to the surface 52 in accordance with Bernoulli's theorem, is further deflected as the carriage 22 travels this distance.

As the sheet 220 is deflected in accordance with Bernoulli's theorem as described above, it is important to note that the tips 170 of registration arms 160 at least initially remain stationary as carriage 22 is rotated away from the hopper. The stationary, elevated tips 170 help support the stack of sheets in the hopper and prevent the deflection of sheet 220 from having an adverse impact on the stack as a whole, such as partial collapse of the stack.

As the carriage rotates downwardly away from the hopper (i.e., in the clockwise sense about the axis of shaft 40), the just-described point is reached whereat the surface 52 is about ⅛ inch below the hopper 200 and tips 170 of the still-stopped registration arms 160. At this point the protrusion stops 168 on the carriage contact the ledges 166 on the registration arms 160. The contact of the protrusion stops 168 and ledges 166, working together with the coupling of leaf spring 162, cause the distal ends of registration arms to also rotate in the clockwise sense about the axis of shaft 40 (meaning that the tails 174 rotate in the clockwise sense away from the stops 164).

After the carriage 22 is rotated in the clockwise sense to cause the approximately ⅛ inch displacement of the front edge of sheet 220 as described above, an electrical signal is applied on an appropriate one of the electrical wires comprising set 136. Activated by the electrical signal, the solenoid valve 132 creates a negative pressure in the negative pressure manifold 122. This negative pressure is communicated by hoses 148 to sucker cups 56A and 56B. The negative pressure at the mouth of the sucker cups 56A and 56B initially creates a seal between the sucker cups 56 and the underside of sheet 220. Following the formation of the seal, the negative pressure created in the sucker cup bellows causes the bellows of the sucker cups 56 to collapse as shown in FIGS. 5E and 6E. In fact, the sucker cup bellows collapse to such an extent that the sucker cup mouth upper surfaces fall below the level of surface 52. Thus, whereas the previously uncollapsed sucker cups 56 had extended above the level of surface 52, upon collapse the sucker cups 56 fall below the level of surface 52.

As the sucker cups 56 collapse in the aforedescribed manner, the underside portions of sheet 220 contacted by the mouths of the sucker cups 56 are also forced downwardly below the level of surface 52. The collapse of the sucker cups 56 deflects the sheet 220 over the surface 52. At least by the time the jet of positive pressure air issuing from port 54 is terminated, the sheet 220 is held against the surface 52. Once the lowermost sheet 220 has been attracted onto the sucker cups 56 in the manner just described, electrical signals on wire set 134 are terminated so that the transmission of the positive pressure fluid through hoses 142 and port 54 ceases.

After the sucker cups 56 have collapsed in the manner shown in FIGS. 5E and 6E, from the front of the hopper 200 the front of the sheet 220 appears to be in a smooth "W" configuration. In this respect, a first end of the sheet is held up by tip 170A of registration arm 160A; the vacuum applied through collapsed sucker cup 56A causes a first trough at approximately one quarter of the distance from registration arm 160A to arm 160B; the surface 52 causes a relatively flat crest at approximately one half of the distance from registration arm 160A to arm 160B; the vacuum applied through collapsed sucker cup 56B causes a second trough at approximately three quarters of the distance from registration arm 160A to arm 160B; and, the tip 170B of registration arm 160B holds up the second end of the sheet 220.

For the embodiment shown herein the distance between the registration arms 160A and 160B remains constant. For the illustrated embodiments sheets having widths in a range from 5 inches in width to 9.5 inches in width are feedable without adjustment of the distance between the registration arms 160A, 160B.

From the foregoing it is seen that the negative pressure applied through the sucker cups 56 bends or deflects the lowermost sheet 220 about the region of the positive pressure fluid application means 46, thereby deflecting the lowermost sheet 220 about a second axis 240 of the sheet. As seen in FIG. 6E, the second axis 240 is essentially perpendicular to the first axis 208 and results from the intermediate placement of the positive pressure fluid application means 46 between the sucker cups 56A and 56B.

In connection with the foregoing, the attraction of the lowermost sheet 220 onto the sucker cups 56 creates air pockets on both sides of the second axis 240 and above positions of the sucker cups 56 (i.e., above the troughs formed proximate the front edge of sheet 220). The air pockets serve to better vent the region between the lowermost sheet 220 and the next lowermost sheet 230 in the hopper 200, thereby tending to further combat the creation of an induced vacuum.

As the roller 70 rides on the second surface of the unillustrated cam, carriage 22 continues to rotate downwardly in the clockwise direction as shown in FIGS. 5F and 6F, further deflecting sheet 220 about its first axis 208. In this respect, the rate of travel of carriage 22 as depicted at the time shown at FIGS. 5F and 6F can, in a preferred embodiment, be faster than the rate of travel of the carriage 22 at the time shown in FIG. 5D and 6D. In this respect, at the time shown in FIGS. 5F and 6F, the carriage 22 (and hence the lowermost sheet 220 attracted thereon) is already distanced sufficiently from the next lowermost sheet such that a more rapid rate of travel of the carriage 22 will not set up undesirable induced vacuum conditions. The rate of travel of the carriage 22 is, of course, ultimately governed by the contour of the unillustrated cam.

When the lowermost sheet 220 has been sufficiently deflected about its first axis 208, a separating device such as unillustrated separator foot is interposed between the deflected lowermost sheet 220 and the next lowermost sheet 240 in the hopper. The vacuum to the sucker cups 56 is then terminated and the carriage 22 is rotated further away in the clockwise direction. At this point an unillustrated gripper jaw-like structure can rotate toward the deflected lowermost sheet 220, engage the sheet 220, and extract the sheet 220 for such further purposes as, for example, deposition of the sheet 220 onto an insert track.

While the invention has been particularly shown and described with reference to the preferred embodiments thereof, it will be understood by those skilled in the art that various alterations in form and detail may be made therein without departing from the spirit and scope of the invention. For example, in some embodiments the motion of carriage 22 away from hopper 200 may be temporarily halted to cause a dwell before the carriage resumes its travel away from the hopper 200. This delay or dwell precludes the carriage 22 from traveling too quickly away from the hopper 200, thereby prevent the travel of carriage 22 from contributing to the creation of what might otherwise be an induced vacuum.

The embodiments of the invention in which an exclusive property or privilege is claimed are defined as follows:

1. A device for at least partially separating a next-awaiting sheet from a hopper in which a plurality of sheets are storable, said device comprising:

a carriage;

means for selectively moving said carriage toward and away from a storage position in which said next-awaiting sheet in said hopper lies;

means mounted on said carriage for applying fluid of positive pressure, said positive pressure application means comprising a port, said port being connectable to a source of fluid of positive pressure in a manner whereby at least a portion of said next-awaiting sheet in said hopper is attracted to said positive pressure application means when said carriage is moved toward said sheet storage position; and, means mounted on said carriage for applying fluid of negative pressure, said negative pressure application means being connectable to a source of fluid of negative pressure for communicating negative pressure to a next-awaiting sheet after said next-awaiting sheet has been attracted toward said positive pressure application means, whereby upon the application of said negative pressure fluid at least a portion of said next-awaiting sheet is attracted onto said negative pressure application means as said carriage moves away from said sheet storage position.

2. The device of claim 1, wherein said positive pressure application means is positioned relative to said negative pressure application means in a manner whereby the negative pressure applied by said negative pressure application means causes said attracted sheet to be deflected about said positive pressure application means.

3. The device of claim 2, wherein said negative pressure application means comprises at least two sucker cups, a first of said sucker cups being positioned on a first side of said positive pressure application means and a second of said sucker cups being positioned on a second side of said positive pressure application means.

4. The device of claim 3, wherein said positive pressure application means comprises a surface mounted on said carriage, said surface having said port formed therein.

5. The device of claim 4, wherein said sucker cups are collapsible sucker cups, said collapsible sucker cups having mouth portions which extend above the surface of said positive pressure application means when said sucker cups are not collapsed but which fall below said surface when the application of negative pressure through said sucker cups causes the sucker cup to collapse.

6. The device of claim 1, wherein said positive pressure application means comprises a surface mounted on said carriage, said surface having said port formed therein.

7. The device of claim 1, wherein said positive pressure application means is positioned relative to said negative pressure application means in a manner whereby the negative pressure applied by said negative pressure application means causes said attracted sheet to be deflected about an axis of said sheet.

8. The device of claim 7, wherein said negative pressure application means comprises a sucker cup, said sucker cup being positioned on a first side of said positive pressure application means in a manner to cause said attracted sheet to be deflected about an axis of said sheet.

9. The device of claim 8, wherein said positive pressure application means comprises a surface mounted on said carriage, said surface having said port formed therein.

10. The device of claim 9, wherein said sucker cup is a collapsible sucker cup, said collapsible sucker cup having a mouth portion which extends above the surface of said positive pressure application means when said sucker cup is not collapsed but which falls below said surface when the application of negative pressure through said sucker cup causes the sucker cup to collapse.

11. A method of at least partially separating a next-awaiting sheet from a hopper in which a plurality of such sheets are storable, said method comprising the steps of:

(1) moving a carriage toward a said next-awaiting sheet lying in a storage position in said hopper;

(2) applying fluid of positive pressure through positive pressure application means mounted on said carriage, said positive pressure fluid being applied in a manner whereby at least a portion of said next-awaiting sheet in said hopper is attracted to said positive pressure application means;

(3) moving said carriage away from said storage position of said next-awaiting sheet, thereby deflecting at least a portion of said next-awaiting sheet about a first axis thereof;

(4) applying fluid of negative pressure through negative pressure application means mounted on said carriage, whereby at least a portion of said next-awaiting sheet attracted to said positive pressure application means is attracted onto said negative pressure application means; and, (5) moving said carriage further away from said storage position of said next-awaiting sheet, said portion of said next-awaiting sheet attracted onto said negative pressure application means thereby being further deflected about its first axis.

12. The method of claim 11, wherein in step (3) said carriage is moved away from said storage position and then at least temporarily stopped, and wherein fluid is applied through said positive pressure application means while said carriage is being moved away from said storage position and while said carriage is temporarily stopped.

13. The method of claim 11, further comprising the step of:

terminating the application of said positive pressure fluid.

14. The method of claim 11, further comprising the step of:

using said negative pressure fluid applied through said negative pressure application means to deflect said sheet about a second axis of said next-awaiting sheet.

15. The method of claim 14, wherein said negative pressure fluid applied through said negative pressure application means deflects said next-awaiting sheet about a surface comprising said positive pressure application means.

16. The method of claim 10, wherein said negative pressure fluid is applied through collapsible sucker cups in a manner to deflect said next-awaiting sheet about said surface, said collapsible sucker cup having mouth portions which extend above the surface of said positive pressure application means when said sucker cups are not collapsed but which fall below said surface when the application of negative pressure through said sucker cups causes the sucker cups to collapse.

17. A method of at least partially separating a next-awaiting sheet from a hopper in which a plurality of sheets are storable, said method comprising the steps of:

(1) moving a carriage toward said next-awaiting sheet lying in a storage position in said hopper;

(2) applying positively pressurized fluid through first fluid application means mounted on said carriage to attract at least a portion of said next-awaiting sheet in said hopper to said first fluid application means;

(3) moving said carriage away from said storage position of said sheet, thereby deflecting at least a portion of said sheet about a first axis thereof;

(4) applying a vacuum through second fluid application means mounted on said carriage, whereby at least a portion of said sheet is attracted to said second fluid application means, thereby deflecting said sheet about a second axis of said sheet; and, (5) moving said carriage further away from said storage position of said sheet.

18. A device for at least partially separating an next-awaiting sheet from a hopper in which a plurality of such sheets are storable, said device comprising:

first pressure application means for applying positive air pressure in a manner whereby at least a portion of said next-awaiting sheet in said hopper is attracted to said first pressure application means when said first pressure application means is sufficiently close to said hopper;

second pressure application means for applying negative air pressure in a manner whereby upon the application of said negative air pressure at least a portion of said next-awaiting sheet is attracted onto said second pressure application means when said second pressure application means is proximate said hopper;

first control means fluidically connected to said first pressure application means for controlling the communication of positive air pressure to said first pressure application means;

second control means fluidically connected to said second pressure application means for controlling the communication of negative air pressure to said second pressure application means; and, means for selectively moving said first pressure application means and said second pressure application means toward and away from a storage position in which said next-awaiting sheet in said hopper lies.

19. The device of claim 18, wherein said means for selectively moving said first pressure application means and said second pressure application means comprises a carriage upon which both said first pressure application means and said second pressure application means are mounted in a manner for moving in unison at least during a portion of the extent of travel.

20. The device of claim 19, wherein said first pressure application means comprises a surface formed on said carriage, said surface having a port formed therein through which positive air pressure is applied.

21. The device of claim 18, wherein said first pressure application means is positioned relative to said second pressure application means in a manner whereby the negative pressure applied by said negative pressure application means causes said attracted sheet to be deflected about said first pressure application means.

22. The device of claim 21, wherein said second pressure application means comprises at least two sucker cups, a first of said sucker cups being positioned on a first side of said first pressure application means and a second of said sucker cups being positioned on a second side of said first pressure application means.

23. The device of claim 23, wherein said first pressure application means comprises a surface mounted on said carriage, said surface having said port formed therein.

24. The device of claim 23, said sucker cups are collapsible sucker cups, said collapsible sucker cups having mouth portions which extend above the surface of said first pressure application means when said sucker cups are not collapsed but which fall below said surface when the application of negative pressure through said sucker cups causes the sucker cup to collapse.

25. The device of claim 18, wherein said first pressure application means is positioned relative to said second pressure application means in a manner whereby the negative pressure applied by said negative pressure application means causes said attracted sheet to be deflected about an axis of said sheet. .

26. The device of claim 25, wherein said second pressure application means comprises a sucker cup, said sucker cups being positioned on a first side of said first pressure application means in a manner to cause said attracted sheet to be deflected about an axis of said sheet.

27. The device of claim 26, wherein said first pressure application means comprises a surface mounted on said carriage, said surface having said port formed therein.

28. The device of claim 27, wherein said sucker cup is a collapsible sucker cup, said collapsible sucker cup having a mouth portion which extends above the surface of said first pressure application means when said sucker cup is not collapsed but which falls below said surface when the application of negative pressure through said sucker cup causes the sucker cup to collapse.

29. A method of at least partially separating a next-awaiting sheet from a hopper in which a plurality of such sheets are storable, said method comprising the steps of:

(1) moving positive pressure application means toward said next-awaiting sheet lying in a storage position in said hopper;

(2) applying fluid of positive pressure through said positive pressure application means, said positive pressure fluid being applied in a manner whereby at least a portion of said next-awaiting sheet in said hopper is attracted to said positive pressure application means;

(3) moving said positive pressure application means away from said storage position of said next-awaiting sheet, thereby deflecting at least a portion of said next-awaiting sheet about a first axis thereof;

(4) applying fluid of negative pressure through negative pressure application means, whereby at least a portion of said next-awaiting sheet attracted to said positive pressure application means is attracted onto said negative pressure application means; and, (5) moving said positive pressure application means and said negative pressure application means further away from said storage position of said next-awaiting sheet, said portion of said next-awaiting sheet attracted onto said negative pressure application means thereby being further deflected about its first axis.

30. The method of claim 29, wherein in step (3) said positive pressure application means is rotated away from said storage position and then at least temporarily stopped, and wherein fluid is applied through said positive pressure application means while said carriage is being moved away from said storage position and while said carriage is temporarily stopped.

31. The method of claim 29, wherein said positive pressure application means and said negative pressure application means are moved in unison through at least a portion of their extent of travel.

32. A method of at least partially separating a next-awaiting sheet from a hopper in which a plurality of sheets are storable, said method comprising the steps of:

(1) moving first pressure application means toward said next-awaiting sheet lying in a storage position in said hopper;

(2) applying positively pressurized fluid through said first pressure application means to attract at least a portion of said next-awaiting sheet in said hopper to said first fluid application means;

(3) moving said first pressure application means away from said storage position of said sheet, thereby deflecting at least a portion of said sheet about a first axis thereof;

(4) applying a vacuum through second pressure application means, whereby at least a portion of said sheet is attracted to said second pressure application means, thereby deflecting said sheet about a second axis of said sheet; and, (5) moving said first pressure application means and said second pressure application means further away from said storage position of said sheet.

33. A device for at least partially separating a next-awaiting sheet from a hopper in which a plurality of such sheets are storable, said device comprising:

sheet attraction means for attracting said next-awaiting sheet toward said sheet attraction means;

sheet registration means having a sheet-contacting portion for selectively contacting at least a portion of a first side of said next-awaiting sheet when said next-awaiting sheet is in said storage position;

means for translating said sheet attraction means and said sheet registration means toward said next-awaiting sheet lying in a storage position in said hopper, said translation occurring in a manner whereby said sheet registration means and said sheet attraction means travel in unison during at least a portion of the extent of travel and for translating said sheet attraction means with a portion of said sheet attracted thereto away from said hopper; and, means for maintaining said sheet-contacting portion of said sheet registration means stationary until said sheet attraction means with said sheet attracted thereto has been translated a predetermined distance away from said hopper; said sheet-contacting portion of said sheet registration means serving to support a portion of said sheet while said portion of said sheet attracted to said sheet attraction means is deflected during said translation.

34. The device of claim 33, further comprising:

a carriage upon which said sheet attraction means is mounted in a manner for responsive connection to said translating means.

35. The device of claim 33, further comprising:

means for coupling said sheet attraction means and said sheet registration means in a manner whereby a predetermined spacing is at least temporarily provided between said sheet-contacting portion of said sheet registration means and said sheet attraction means.

36. The device of claim 35, wherein said coupling is a flexible coupling.

37. The device of claim 35, wherein said predetermined spacing is maintained until said sheet registration means contacts a first side of said next-awaiting sheet.

38. The device of claim 33 further comprising:

stop means for limiting the extent of travel of said sheet registration means toward said storage position, said stop means being situated to limit the extent of travel of said sheet registration means when said sheet registration means contacts at least a portion of a first side of said next-awaiting sheet.

39. The device of claim 33, wherein said sheet registration means comprises two sheet registration arms arranged on opposite sides of said sheet attraction means.

40. The device of claim 39, wherein said sheet attraction means further comprises:

first pressure application means for applying positive air pressure in a manner whereby at least a portion of said next-awaiting sheet in said hopper is attracted to said first pressure application means when said first pressure application means is sufficiently close to said hopper; and, second pressure application means for applying negative air pressure in a manner whereby upon the application of said negative air pressure at least a portion of said next-awaiting sheet is attracted onto said second pressure application means when said second pressure application means is proximate said hopper.

41. The device of claim 33, wherein said sheet attraction means further comprises:

first pressure application means for applying positive air pressure in a manner whereby at least a portion of said next-awaiting sheet in said hopper is attracted to said first pressure application means when said first pressure application means is sufficiently close to said hopper; and, second pressure application means for applying negative air pressure in a manner whereby upon the application of said negative air pressure at least a portion of said next-awaiting sheet is attracted onto said second pressure application means when said second pressure application means is proximate said hopper.

42. A method of at least partially separating a next-awaiting sheet from a hopper in which a plurality of sheets are storable, said method comprising the steps of:

translating sheet attraction means and sheet registration means toward said next-awaiting sheet lying in a storage position in said hopper;

said translation occurring in a manner whereby said sheet registration means and said sheet attraction means travel in unison during at least a portion of the extent of travel;

attracting said next-awaiting sheet toward said sheet attracting means;

translating said sheet attraction means with a portion of said sheet attracted thereto away from said hopper;

maintaining said sheet-contacting portion of said sheet registration means stationary until said sheet attraction means with said sheet attracted thereto has been translated a predetermined distance away from said hopper, said sheet-contacting portion of said sheet registration means serving to support a portion of said sheet while said portion of said sheet attracted to said sheet attraction means is deflected during said translation.

43. The method of claim 42 further comprising the step of translating said sheet attraction means further toward said hopper after said sheet registration means has contacted said first side of said next-awaiting sheet.

44. The method of claim 42, wherein said step of attracting said next-awaiting sheet toward said sheet attraction means comprises the steps of:

applying fluid of positive pressure through positive pressure application means, said positive pressure fluid being applied in a manner whereby at least a portion of said next-awaiting sheet in said hopper is attracted to said positive pressure application means; and, applying fluid of negative pressure through negative pressure application means, whereby at least a portion of said next-awaiting sheet attracted to said positive pressure application means is attracted onto said negative pressure application means.

45. The method of claim 44, wherein said negative pressure fluid applied through said negative pressure application means deflects said next-awaiting sheet about a surface comprising said positive pressure application means.

46. The method of claim 45, wherein said negative pressure fluid is applied through collapsible sucker cups is a manner to deflect said next-awaiting sheet about said surface, said collapsible sucker cup having mouth portions which extend above the surface of said positive pressure application means when said sucker cups are not collapsed but which fall below said surface when the application of negative pressure through said sucker cups causes the sucker cups to collapse.

47. The method of claim 42, further comprising the steps of:

coupling said sheet attraction means and said sheet registration means in a manner whereby a predetermined spacing is at least temporatily provided between a sheet-contacting portion of said sheet registration means and said sheet attraction means;

maintaining said predetermined spacing until said sheet-contacting portion of said sheet registration means contacts a portion of a first side of said next-awaiting sheet lying in said storage position.

* * * * *